US011535476B2

(12) United States Patent
Nagai et al.

(10) Patent No.: US 11,535,476 B2
(45) Date of Patent: Dec. 27, 2022

(54) SHEET STACKING DEVICE, SHEET STACKING METHOD, SHEET STACKING PROGRAM, COUNTER EJECTOR, AND BOX MAKING MACHINE

(71) Applicant: MITSUBISHI HEAVY INDUSTRIES, LTD., Tokyo (JP)

(72) Inventors: Hideaki Nagai, Tokyo (JP); Hiroyuki Kanazawa, Tokyo (JP); Koshi Tanimoto, Tokyo (JP); Kenta Nakao, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 10 days.

(21) Appl. No.: 17/158,701

(22) Filed: Jan. 26, 2021

(65) Prior Publication Data

US 2021/0300710 A1 Sep. 30, 2021

(30) Foreign Application Priority Data

Mar. 30, 2020 (JP) ..... JP2020-061481

(51) Int. Cl.

| | |
|---|---|
| ***B65H 29/24*** | (2006.01) |
| ***B31B 50/00*** | (2017.01) |
| ***B31B 50/98*** | (2017.01) |
| ***B31B 50/04*** | (2017.01) |
| ***B65H 9/10*** | (2006.01) |

(52) U.S. Cl.

CPC ..... *B65H 29/246* (2013.01); *B31B 50/006* (2017.08); *B31B 50/042* (2017.08); *B31B 50/98* (2017.08); *B65H 9/108* (2013.01); *B65H 2406/12* (2013.01)

(58) Field of Classification Search

CPC ..... B65H 29/246; B65H 9/108; B65H 2406/12; B65H 29/66; B65H 29/68; B65H 31/00; B31B 50/006; B31B 50/98; B31B 50/042; B31B 50/02; B31B 50/04; B31B 50/06; B31B 50/10

USPC ..... 493/126

See application file for complete search history.

(56) References Cited

U.S. PATENT DOCUMENTS

2011/0024972 A1* 2/2011 Schneider ..... B65H 29/6609 271/119
2017/0327330 A1* 11/2017 Aoki ..... B65H 3/5261
2019/0351636 A1* 11/2019 Akita ..... B65H 33/00

FOREIGN PATENT DOCUMENTS

JP 2018-118391 8/2018

* cited by examiner

*Primary Examiner* — Sameh Tawfik
(74) *Attorney, Agent, or Firm* — Wenderoth, Lind & Ponack, L.L.P.

(57) ABSTRACT

A sheet stacking device is provided with a hopper unit configured to stack a sheet, a feeding unit configured to feed out the sheet to the hopper unit, a distance detection unit configured to detect an inter-sheet distance, in the vertical direction, between a rear end portion of the sheet that is preceding and a tip end portion of the sheet that is subsequent, and an output unit configured to output a behavior stabilization command for the sheet based on the inter-sheet distance.

12 Claims, 13 Drawing Sheets

SHEET STACKING DEVICE, SHEET STACKING METHOD, SHEET STACKING PROGRAM, COUNTER EJECTOR, AND BOX MAKING MACHINE

CROSS-REFERENCE TO RELATED APPLICATIONS

This application claims the benefit of priority to Japanese Patent Application Number 2020-061481 filed on Mar. 30, 2020. The entire contents of the above-identified application are hereby incorporated by reference.

TECHNICAL FIELD

The present disclosure relates to a sheet stacking device, a sheet stacking method, a sheet stacking program, a counter ejector, and a box making machine.

RELATED ART

A box making machine generally manufactures box bodies (corrugated cardboard boxes) by processing a sheet material (a corrugated cardboard sheet, for example). The box making machine includes a sheet feeding unit, a printing unit, a sheet ejection unit, a die cutting unit, a folder gluer unit, and a counter ejector unit. The sheet feeding unit feeds, to the printing unit, the corrugated cardboard sheets stacked on a table one by one at a constant speed. The printing unit includes a print unit, and performs printing on the corrugated cardboard sheets. The sheet ejection unit forms ruled lines serving as folding lines in the printed corrugated cardboard sheet, and also performs processing for forming grooves, which form flaps, and adhesive flaps for joining. The die cutting unit performs a blanking operation for forming a hand hole or the like in the corrugated cardboard sheet in which the ruled lines, the grooves, and the adhesive flaps have been formed. While moving the corrugated cardboard sheet in which the ruled lines, the grooves, the adhesive flaps, and the hand hole have been formed, the folder gluer unit applies glue to the adhesive flaps, folds the adhesive flaps along the ruled lines, and joins the adhesive flaps in order to manufacture a flat-shaped corrugated cardboard box. The counter ejector unit stacks the corrugated cardboard boxes, each of which has been formed as a result of the corrugated cardboard sheet being folded and glued together, groups the corrugated cardboard boxes into batches of a predetermined number, and ejects the corrugated cardboard boxes.

The counter ejector unit includes a hopper unit in which the corrugated cardboard boxes are stacked, and an air blower device that presses the corrugated cardboard boxes downward. The corrugated cardboard boxes are fed out to a space above the hopper unit by feeding rolls. Then, after a tip end portion of the corrugated cardboard box collides with a stopper, the corrugated cardboard box falls due to air blown from the air blower device and its own weight, and drops in the hopper unit to be stacked. An example of such a box making machine is disclosed in JP 2018-118391 A described below.

SUMMARY

After being fed out to the space above the hopper unit, the tip end portion of the corrugated cardboard box collides with the stopper, and then the corrugated cardboard box falls. At this time, the next corrugated cardboard box is fed out to the space above the hopper unit. Therefore, there is a risk that a rear end portion of the corrugated cardboard box, which is dropping in the hopper unit, and a tip end portion of the next corrugated cardboard box, which is fed out to the space above the hopper unit, may come into contact with each other. When the rear end portion of the dropping corrugated cardboard box and the tip end portion of the next corrugated cardboard box come into contact with each other, a problem arises in which the corrugated cardboard box does not drop into the hopper unit appropriately, and a production loss occurs due to sheet jamming. In known art, an operator adjusts a transport speed or a transport interval of the corrugated cardboard boxes, or adjusts a supply amount or a supply direction of the air from the air blower device. In this case, the operator needs to be highly skilled for performing such an adjustment operation, and also, a burden on the operator is large.

The present disclosure has been conceived to solve the problem described above, and an object of the present disclosure is to provide a sheet stacking device and a sheet stacking method, a sheet stacking program, a counter ejector, and a box making machine that are designed to suppress an occurrence of a production loss due to sheet jamming caused by sheets coming into contact with each other, improve workability of a sheet stacking operation, and improve productivity of the box making machine.

In order to achieve the object described above, a sheet stacking device according to the present disclosure includes a hopper unit configured to stack a sheet, a feeding unit configured to feed out the sheet to the hopper unit, a distance detection unit configured to detect an inter-sheet distance, in a vertical direction, between a rear end portion of the sheet that is preceding and a tip end portion of the sheet that is subsequent, and an output unit configured to output, based on the inter-sheet distance, a behavior stabilization command for the sheet.

Further, a sheet stacking method according to the present disclosure includes feeding out a sheet to a hopper unit, detecting a distance, in a vertical direction, between a rear end portion of the sheet and a tip end portion of the sheet that is subsequent, and outputting a behavior stabilization command for the sheet based on the distance in the vertical direction.

Further, a sheet stacking program according to the present disclosure causes a computer to execute processing for feeding out a sheet to a hopper unit, processing for detecting a distance, in a vertical direction, between a rear end portion of the sheet and a tip end portion of the sheet that is subsequent, and processing for outputting a behavior stabilization command for the sheet based on the distance in the vertical direction.

Further, a counter ejector according to the present disclosure includes the sheet stacking device, and is configured to group the sheets into batches of a predetermined number after stacking the sheets while counting the sheets, and eject the sheets.

Further, a box making machine includes a sheet feeding unit configured to supply a box making sheet material, a printing unit configured to perform printing on the box making sheet material, a sheet ejection unit configured to perform ruled line processing and groove cutting processing on a surface of the box making sheet material, a folder gluer unit configured to form a box body by folding the box making sheet material and joining end portions of the box making sheet material, a counter ejector unit configured to stack the box bodies while counting the box bodies, and eject the box bodies in batches of a predetermined number, and the counter ejector unit is the counter ejector.

A sheet stacking device, a sheet stacking method, a sheet stacking program, a counter ejector, and a box making machine according to the present disclosure can suppress an occurrence of a production loss due to sheet jamming caused by sheets coming into contact with each other, can improve workability of a sheet stacking operation, and can improve productivity of the box making machine.

BRIEF DESCRIPTION OF DRAWINGS

The disclosure will be described with reference to the accompanying drawings, wherein like numbers reference like elements.

DESCRIPTION OF EMBODIMENTS

Preferred embodiments of the present disclosure will be described in detail below with reference to the accompanying drawings. Note that the present disclosure is not limited to these embodiments, and when there are a plurality of the embodiments, the present disclosure is intended to include a configuration combining these embodiments. In addition, constituent elements in those embodiments include elements that can be easily conceived by a person skilled in the art, elements that are substantially the same, and elements having an equivalent scope so to speak.

First Embodiment

Box Making Machine

Figure 1:
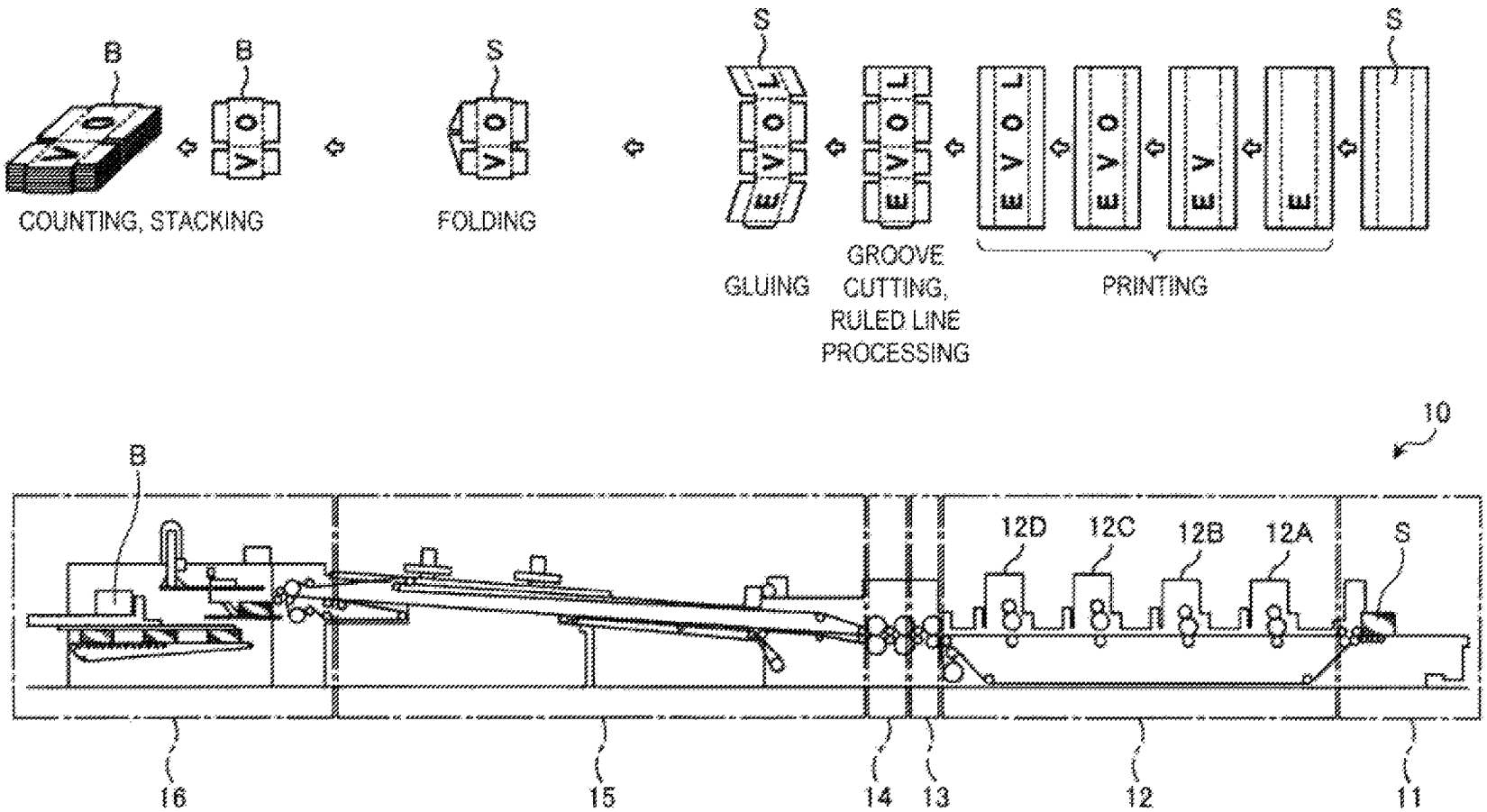
FIG. 1 is a schematic configuration diagram illustrating a box making machine according to a first embodiment.

FIG. 1 is a schematic configuration diagram illustrating a box making machine according to a first embodiment.

In the first embodiment, as illustrated in FIG. 1, a box making machine 10 manufactures a corrugated cardboard box (sheet) B by processing a corrugated cardboard sheet S. The box making machine 10 includes a sheet feeding unit 11, a printing unit 12, a sheet ejection unit 13, a die cutting unit 14, a folder gluer unit 15, and a counter ejector unit 16. The sheet feeding unit 11, the printing unit 12, the sheet ejection unit 13, the die cutting unit 14, the folder gluer unit 15, and the counter ejector unit 16 are arranged so as to form a straight line in a direction in which the corrugated cardboard sheet S and the corrugated cardboard box B are transported.

The corrugated cardboard sheets S, each having a plate-like shape, are delivered being loaded in a large quantity, and then, the sheet feeding unit 11 feeds the corrugated cardboard sheets S one by one at a constant speed to the printing unit 12. The printing unit 12 performs multi-color printing (four-color printing in the first embodiment) on the surface of the corrugated cardboard sheet S. The printing unit 12 includes four print units 12A, 12B, 12C and 12D disposed in series, and performs printing on the surface of the corrugated cardboard sheet S using four ink colors. The sheet ejection unit 13 performs ruled line processing and groove cutting processing on the corrugated cardboard sheet S.

The die cutting unit 14 performs a blanking operation for forming a hand hole and the like, on the corrugated cardboard sheet S. The folder gluer unit 15 folds the corrugated cardboard sheet S while moving the corrugated cardboard sheet S in a transport direction, and forms the corrugated cardboard box B having a flat shape by joining both end portions, in the width direction, of the corrugated cardboard sheet S. The counter ejector unit 16 stacks the corrugated cardboard boxes B manufactured by the folder gluer unit 15 while counting the corrugated cardboard boxes B, groups the corrugated cardboard boxes B into batches of a predetermined number, and ejects the corrugated cardboard boxes B.

Counter Ejector

Figure 2:
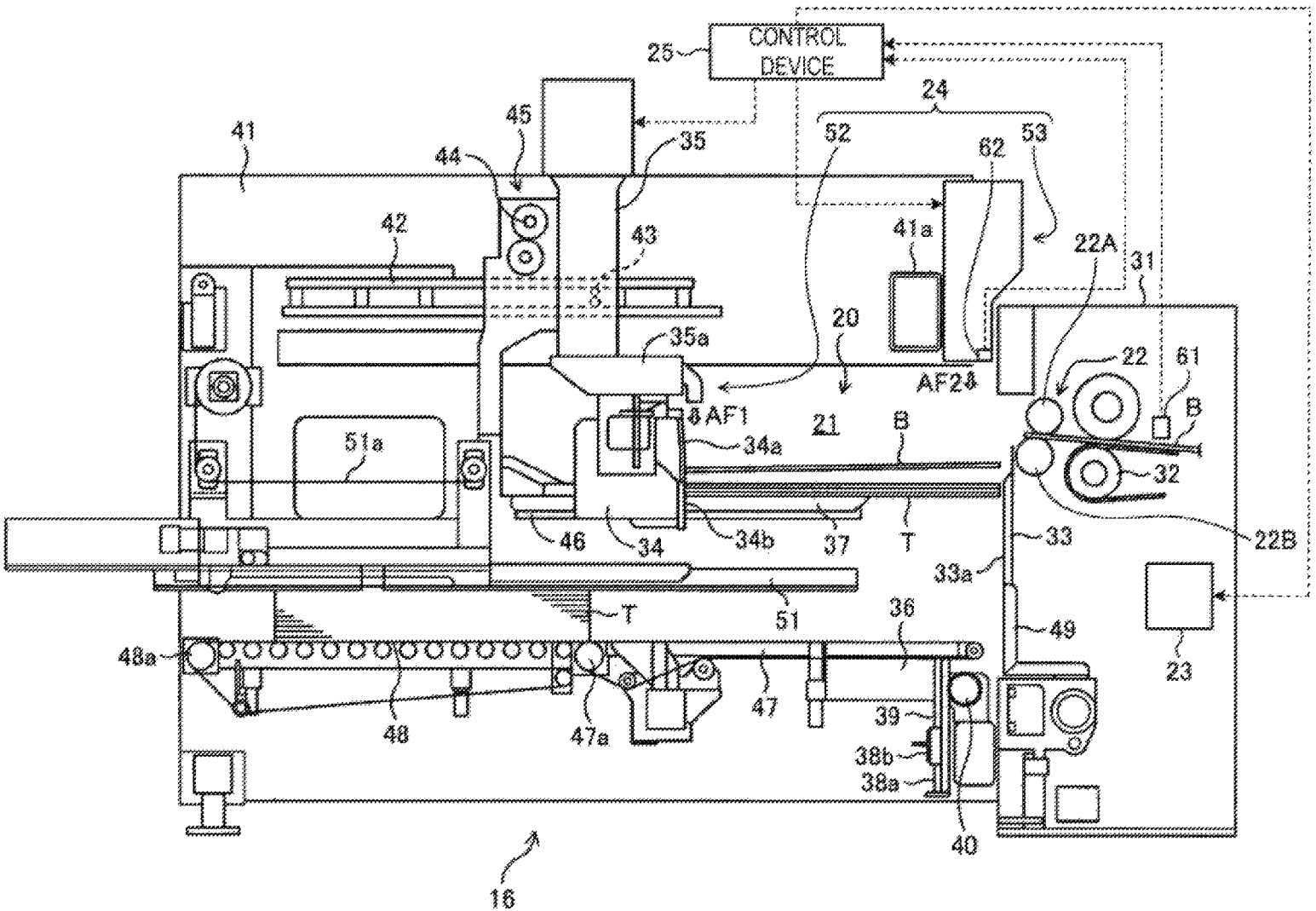
FIG. 2 is a schematic configuration diagram illustrating a counter ejector including a sheet stacking device according to the first embodiment.

FIG. 2 is a schematic configuration diagram illustrating the counter ejector provided with the sheet stacking device according to the first embodiment.

As illustrated in FIG. 2, the counter ejector unit (counter ejector) 16 includes a sheet stacking device 20 according to the first embodiment. The sheet stacking device 20 is configured to stack the continuously transported corrugated cardboard boxes B in a predetermined position. The sheet stacking device 20 includes a hopper unit 21, feeding rolls (a feeding unit) 22, a transport drive device 23, an air blower device 24, and a control device 25. The hopper unit 21 stacks the flat-shaped corrugated cardboard boxes B. The feeding rolls 22 continuously feed the corrugated cardboard boxes B to the hopper unit 21. The transport drive unit 23 drives the feeding rolls 22 to rotate at a predetermined speed. The air blower device 24 blows air from above onto the corrugated cardboard box B transported to a space above the hopper unit 21. The control device 25 operates and controls the transport drive device 23 and the air blower device 24.

The counter ejector unit 16 includes frames 31 that are vertically provided on both sides of an inlet portion in a machine width direction. The frames 31 are provided with an outlet conveyor roller 32 of the folder gluer unit 15 (see FIG. 1) and the pair of upper and lower feeding rolls 22. The feeding rolls 22 include an upper feeding roll 22A and a lower feeding roll 22B each having a rotation axial center in the horizontal direction orthogonal to the transport direction of the corrugated cardboard box B. The upper feeding roll 22A and the lower feeding roll 22B face each other in the vertical direction, and feed the corrugated cardboard box B onto a transport path extending along the horizontal direction while sandwiching the corrugated cardboard box B from above and below. The feeding rolls 22 can be driven to rotate by the transport drive device 23.

The frames 31 are provided with a spanker (correction plate) 33 that presses a rear end portion of a stack (a stack of a predetermined number of the corrugated cardboard boxes B) T. The spanker 33 is provided with a contact surface 33*a* that comes into contact with the rear end portion of the corrugated cardboard box B. A lower portion of the contact surface 33*a*, which is a portion below an intermediate portion thereof, is provided so as to extend along the vertical direction, but an upper end of an upper portion of the contact surface 33*a* is inclined so as to be shifted toward an upstream side in the transport direction of the corrugated cardboard box B.

As for the hopper unit 21, a space for forming the stack T by stacking the corrugated cardboard boxes B is provided below an outlet side of the feeding rolls 22, and this space serves as the hopper unit 21. The feeding rolls 22 feed the corrugated cardboard box B toward a space above the hopper unit 21.

The hopper unit 21 is provided with a flexible front stop 34 that faces the hopper unit 21 on a downstream side in the transport direction of the corrugated cardboard box B. The front stop 34 decelerates and stops the corrugated cardboard box B ejected from the folder gluer unit 15. The front stop 34 is supported so as to be movable forward and rearward in the transport direction. Specifically, this front stop 34 is provided so as to be movable forward and rearward in the transport direction of the corrugated cardboard box B by a motor or the like (not illustrated), with respect to a support portion 35*a* of a ledge support 35. The front stop 34 includes a flexible stop plate 34*a* formed of a flexible material, and when a front end portion of the corrugated cardboard box B comes into contact with the flexible stop plate 34*a*, the flexible stop plate 34*a* stops the movement, in the transport direction, of the corrugated cardboard box B while deforming elastically to decelerate the corrugated cardboard box B. However, a high-rigidity stop plate 34*b* formed of a highly rigid material such as metal, for example, is provided in a lower portion of the flexible stop plate 34*a*, and when the rear end portion of the stack T is pressed by reciprocating movements of the spanker 33, the movement of the stack T is regulated at the front edge of the stack T.

An elevator 36 is provided below the hopper unit 21. The stack T accumulated up to partway is delivered to the elevator 36 from a ledge 37, and the elevator 36 receives the corrugated cardboard box B that drops onto the stack T after colliding with the front stop 34, and accumulates the predetermined number of corrugated cardboard boxes B to form the stack T. The elevator 36 is horizontally disposed below the feeding rolls 22 and slightly further on the downstream side in the transport direction than the feeding rolls 22, and is supported by a support shaft 39 provided on a rack 38*a*. The elevator 36 is configured to be able to reciprocate in the vertical direction by a drive mechanism, which is configured by the rack 38*a*, a pinion 38*b* that engages with the rack 38*a*, and a servo motor 40 coupled to the pinion 38*b*.

The counter ejector unit 16 is provided with side frames 41, which are positioned on either side in the machine width direction and further to the downstream side in the transport direction of the corrugated cardboard box B than the hopper unit 21. A horizontal rail 42 is provided on each of the side frames 41, and the ledge support 35 is movably supported by the rails 42 on both sides. In other words, the ledge support 35 is provided with rollers 43 that move on the rails 42, pinions (not illustrated) that engage with racks (not illustrated) provided along the rails 42, and a ledge forward/rearward servo motor 44 that drives the pinions to rotate. Thus, by driving the ledge forward/rearward servo motor 44 in normal and reverse directions, the ledge support 35 can be moved forward and rearward in the transport direction.

The ledge support 35 is provided with the ledge 37 that extends horizontally through a lifting mechanism 45. Although not illustrated in the drawings, the lifting mechanism 45 is configured by a rack/pinion mechanism, a ledge lifting servo motor that drives a pinion to rotate, and the like. Thus, by rotating the servo motor in the normal and reverse directions, the ledge support 35 can be moved up and down.

The ledge 37 receives the corrugated cardboard box B that comes into contact with the front stop 34 and drops, and accumulates the corrugated cardboard boxes B to form the stack T. Then, in the middle of forming the stack T, the ledge 37 delivers the stack T to the elevator 36, and then, after the corrugated cardboard boxes B are further accumulated on the elevator 36, when the number of corrugated cardboard boxes B in the stack T reaches a set number, the ledge 37 starts operating again, and in place of the elevator 36, receives the corrugated cardboard boxes B to form the next stack T.

The ledge 37 is supported so that a press bar 46 that presses the stack T can be moved up and down by a lifting mechanism (not illustrated). This lifting mechanism is also configured by a rack/pinion mechanism and a press bar lifting servo motor that drives a pinion to rotate. Thus, by rotating the servo motor in the normal and reverse directions, the press bar 46 can be moved up and down.

A lower conveyor 47 is provided at the same height as an upper surface of the elevator 36 in the lowest position to which the elevator 36 can move down, and further, on the downstream side of the lower conveyor 47, an ejection conveyor 48 is provided at the same height as the lower conveyor 47. The lower conveyor 47 and the ejection conveyor 48 are driven by a lower conveyor servo motor 47*a* and an ejection conveyor servo motor 48*a*, respectively. The lower conveyor 47 is disposed so as to extend deeply into the elevator 36 so as to be positioned sufficiently close to a pusher 49, so that the lower conveyor 47 can receive even the corrugated cardboard box B whose inlet tip end position has a minimum length (having a minimum length in the transport direction).

An upper conveyor 51, which sandwiches the stack T together with the lower conveyor 47 and the ejection conveyor 48, is supported in position adjustable manner in a height direction with a movement mechanism 51*a* above the lower conveyor 47 and the ejection conveyor 48. Further, the upper conveyor 51 is also movable forward and rearward in the transport direction, and is configured to be movable to a certain distance from the front stop 34 while operating in concert with the front stop 34, in accordance with the corrugated cardboard box B.

Then, around the periphery of the hopper unit 21, the air blower device 24 is provided that blows air flows AF1 and AF2 toward the corrugated cardboard box B fed out from the feeding rolls 22. The air blower device 24 is configured by a first air blower device 52 and a second air blower device 53. The first air blower device 52 is fixed to the support portion 35*a* of the ledge support 35, and thus the first air blower device 52 is disposed above the downstream side, in the transport direction of the corrugated cardboard box B, of the hopper unit 21. The first air blower device 52 presses a tip end side of the corrugated cardboard box B downward using the air flow AF1, by blowing the air flow AF1 toward an upper surface of the corrugated cardboard box B that has been fed out to the hopper unit 21 by the feeding rolls 22.

The second air blower device 53 is fixed to a beam 41*a* supported by both of the side frames 41, and thus the second air blower device 53 is disposed above the upstream side, in the transport direction of the corrugated cardboard box B, of the hopper unit 21. The second air blower device 53 presses a rear end side of the corrugated cardboard box B downward using the air flow AF2, by blowing the air flow AF2 toward the upper surface of the corrugated cardboard box B that has been fed out to the hopper unit 21 by the feeding rolls 22.

Control System of Sheet Stacking Device

Figure 3:
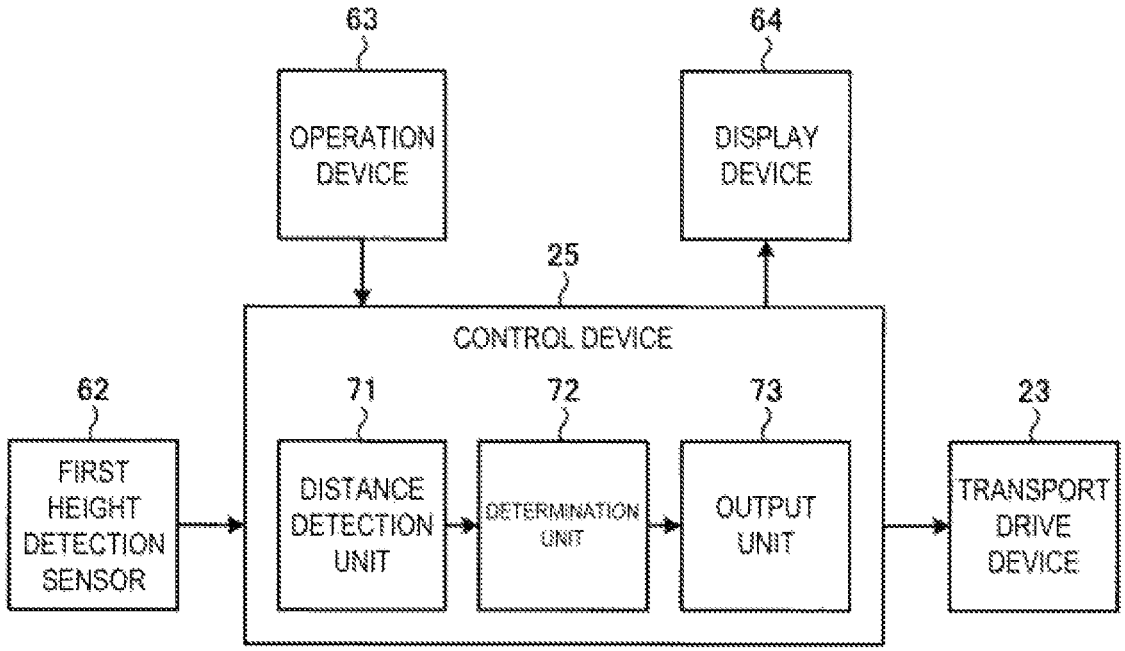
FIG. 3 is a block diagram illustrating a control system of the sheet stacking device according to the first embodiment.
Figure 4:
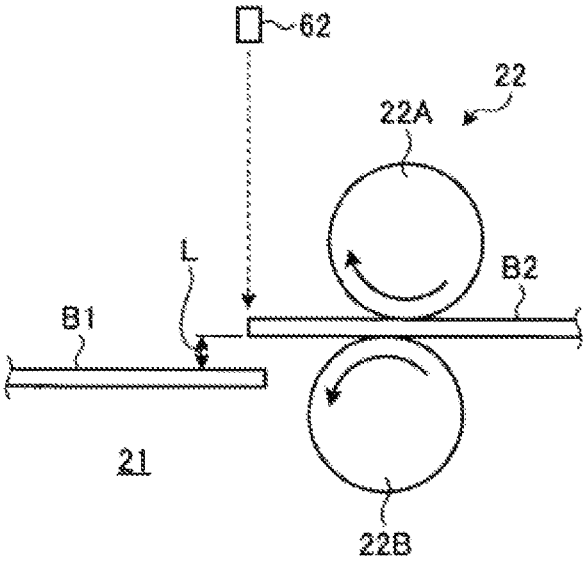
FIG. 4 is a schematic diagram illustrating a sheet distance detection method.
Figure 5:
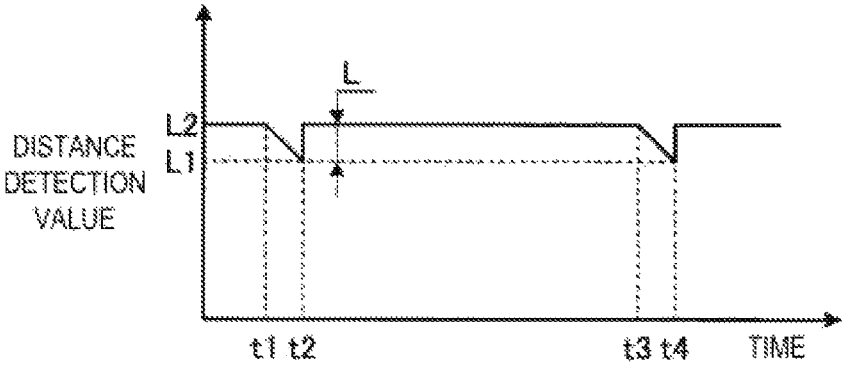
FIG. 5 is a graph showing changes in a distance detection value of a sheet.

FIG. 3 is a block diagram illustrating a control system of the sheet stacking device according to the first embodiment, FIG. 4 is a schematic diagram illustrating a sheet distance detection method, and FIG. 5 is a graph showing changes in a distance detection value of the sheet.

As illustrated in FIG. 2, the control device 25 can operate and control the transport drive device 23 that drives the feeding rolls 22 to rotate, and the first air blower device 52 and the second air blower device 53 that configure the blower unit 24. In this case, the control device 25 controls the rotational speed of the feeding rolls 22, and also controls the air flow rate of the first air blower device 52 and the second air blower device 53. The folder gluer unit 15 (see FIG. 1) is provided with a position detection sensor 61 on the upstream side of the outlet conveyor roller 32. The position detection sensor 61 detects a transport position of the corrugated cardboard box B transported by the outlet conveyor roller 32. The control device 25 calculates the transport position of the corrugated cardboard box B based on a detection result of the position detection sensor 61 and the transport speed of the corrugated cardboard box B by the feeding rolls 22, and controls an operation timing and an air flow rate of the first air blower device 52 and the second air blower device 53, in accordance with the transport position of the corrugated cardboard box B.

Further, as illustrated in FIG. 2 and FIG. 3, the counter ejector unit 16 is provided with a first height detection sensor 62 on the upstream side, in the transport direction of the corrugated cardboard box B, of the hopper unit 21. The first height detection sensor 62 is preferably disposed in a range shifted from an end of the hopper unit 21 on the upstream side in the transport direction of the corrugated cardboard box B, toward the downstream side by a preset predetermined distance (100 mm, for example). The first height detection sensor 62 detects a position of the corrugated cardboard box B in the vertical direction, that is, the height of the corrugated cardboard box B. The first height detection sensor 62 is a non-contact laser distance sensor disposed above the hopper unit 21. The first height detection sensor 62 is provided above the hopper unit 21 in an intermediate portion thereof in the width direction, and a plurality of the first height detection sensors 62 may be provided at predetermined intervals in the width direction. Further, the first height detection sensor 62 is not limited to the laser distance sensor, and may be another type. For example, the first height detection sensor 62 may be a CCD camera disposed on a side of the hopper unit 21 in the width direction.

The control device 25 includes a distance detection unit 71, a determination unit 72, and an output unit 73. The distance detection unit 71 calculates an inter-sheet distance L in the vertical direction, between the rear end portion of the preceding corrugated cardboard box B and the tip end portion of the subsequent corrugated cardboard box B, based on the positions (heights) of the corrugated cardboard boxes B detected by the first height detection sensor 62. The determination unit 72 makes a determination by comparing the inter-sheet distance L calculated by the distance detection unit 71 with a preset inter-sheet distance control value.

The output unit 73 outputs a behavior stabilization command for the corrugated cardboard box B based on a determination result determined by the determination unit 72. In the first embodiment, the behavior stabilization command is a sheet feeding speed command value for the corrugated cardboard box B. In other words, the control device 25 outputs the sheet feeding speed command value for the corrugated cardboard box B to the transport drive device 23 based on the inter-sheet distance L. The sheet feeding speed command value is a command value for the transport speed of the corrugated cardboard box B fed out to the hopper unit 21 as a result of the feeding rolls 22 being rotated by the transport drive device 23.

The corrugated cardboard box B is fed out to the space above the hopper unit 21 by the feeding rolls 22, and after the tip end portion thereof comes into contact with the front stop 34, the corrugated cardboard box B falls. At this time, the subsequent corrugated cardboard box B is fed out to the space above the hopper unit 21. Therefore, there is a risk that the rear end portion of the preceding corrugated cardboard box B and the tip end portion of the subsequent corrugated cardboard box B may come into contact with each other. Thus, by securing a sufficient distance in the vertical direction between the rear end portion of the preceding corrugated cardboard box B and the tip end portion of the subsequent corrugated cardboard box B, the contact between the rear end portion of the preceding corrugated cardboard box B and the tip end portion of the subsequent corrugated cardboard box B is suppressed.

As illustrated in FIG. 4, a preceding corrugated cardboard box B1 fed out to the space above the hopper unit 21 by the feeding rolls 22 falls after a tip end portion thereof comes into contact with the front stop 34 (see FIG. 2). A tip end portion of a subsequent cardboard box B2 enters the space above the hopper unit 21. At this time, a rear end portion of the corrugated cardboard box B1 and the tip end portion of the corrugated cardboard box B2 are separated from each other by a predetermined distance in the vertical direction. The distance detection unit 71 detects the inter-sheet distance L in the vertical direction between the rear end portion of the corrugated cardboard box B1 and the tip end portion of the corrugated cardboard box B2, based on the detection result of the first height detection sensor 62.

As illustrated in FIG. 2 and FIG. 5, the first height detection sensor 62 is disposed above an end portion of the hopper unit 21 on the upstream side in the transport direction of the corrugated cardboard box B, and detects the corrugated cardboard box B fed out to the hopper unit 21. The first height detection sensor 62 detects a height L2, in the vertical direction, of the preceding corrugated cardboard box B1, and, at a time point t1, as the corrugated cardboard box B1 comes into contact with the front stop 34 and start to fall, the height L2 is reduced, and a height L1 is detected. At a time point t2, the first height detection sensor 62 detects the height L2, in the vertical direction, of the tip end portion of the subsequent corrugated cardboard box B. A time point t3 and a time point t4 are similar to the time point t1 and the time point t2. The distance detection unit 71 (see FIG. 3) compares, at the time point t2, for example, the height L1 of the rear end portion of the preceding corrugated cardboard box B1 detected by the first height detection sensor 62 with the height L2 of the tip end portion of the subsequent corrugated cardboard box B, and obtains the inter-sheet distance L by subtracting the height L1 from the height L2.

As illustrated in FIG. 3, the determination unit 72 makes a determination by comparing the inter-sheet distance L calculated by the distance detection unit 71 with an inter-sheet distance control value Ls. The inter-sheet distance control value Ls is a minimum value of a distance at which the rear end portion of the preceding corrugated cardboard box B1 and the tip end portion of the corrugated cardboard box B2 do not come into contact with each other, and is 30 mm, for example. However, the inter-sheet distance control value Ls may be appropriately set in accordance with the size and thickness of the corrugated cardboard box B. The output unit 73 outputs the sheet feeding speed command value for the corrugated cardboard box B to the transport drive device 23 based on the determination result of the determination unit 72. Here, when it is determined that the inter-sheet distance L is greater than the inter-sheet distance control value Ls, the output unit 73 increases the sheet feeding speed command value. On the other hand, when it is determined that the inter-sheet distance L is smaller than the inter-sheet distance control value Ls, the output unit 73 decreases the sheet feeding speed command value. Note that a configuration may be adopted in which, when the inter-sheet distance L is smaller than the inter-sheet distance control value Ls, it is impossible to change (increase) the sheet feeding speed command value.

Further, the control device 25 is connected to an operation device 63, and a display device 64 as an alarm device. An operator can input various command values to the control device 25 by operating the operation device 63. For example, using the operation device 63, the operator can input or change the sheet feeding speed command value in place of the output unit 73. In this case, it is possible to select which of the sheet feeding speed command value from the operation device 63, and the sheet feeding speed command value from the output unit 73 is to be prioritized, using a switching device (not illustrated) or the like. In other words, the operator can switch updating processing of the sheet feeding speed command value between automatic and manual, using the switching device.

The display device 64 displays various outputs from the control device 25, and notifies the operator. The display device 64 as the alarm device is a display, but may be a speaker, for example, as an alarm device. For example, when the input of the sheet feeding speed command value from the control device 25 to the transport drive device 23 is set to be automatic, as described above, the distance detection unit 71 calculates the inter-sheet distance L, the determination unit 72 makes a determination by comparing the inter-sheet distance L with the inter-sheet distance control value Ls, and the output unit 73 outputs the sheet feeding speed command value for the corrugated cardboard box B to the transport drive device 23. On the other hand, when the input of the sheet feeding speed command value from the control device 25 to the transport drive device 23 is set to be manual, the control device 25 outputs, to the display device 64, an alarm command value as the behavior stabilization command based on the inter-sheet distance L.

In other words, by displaying the determination result of the determination unit 72 on the display device 64, the control device 25 prompts the operator to input the sheet feeding speed command value for the corrugated cardboard box B into the transport drive device 23. Here, when it is determined that the inter-sheet distance L is greater than the inter-sheet distance control value Ls, the display device 64 displays information indicating that the sheet feeding speed command value should be increased. On the other hand, when it is determined that the inter-sheet distance L is smaller than the inter-sheet distance control value Ls, the display device 64 displays information indicating that the sheet feeding speed command value should be decreased.

In the description above, it is described that the control device 25 outputs the sheet feeding speed command value for the corrugated cardboard box B to the transport drive device 23 based on the inter-sheet distance L, but the configuration is not limited thereto. As illustrated in FIG. 2, the control device 25 may output an air flow rate command value, as the behavior stabilization command, to the air blower device 24, based on the inter-sheet distance L. For example, when it is determined that the inter-sheet distance L is smaller than the inter-sheet distance control value Ls, the air flow rate command value is increased. In this case, it is preferable to control the second air blower device 53.

Note that the control device 25 includes, for example, a central processing unit (CPU), a random access memory (RAM), a read only memory (ROM), a computer-readable storage medium, and the like. Further, for example, a series of processing for implementing various functions is stored in a storage medium or the like in the form of a program, and the various functions are implemented by the CPU loading the program onto the RAM or the like and executing information processing and arithmetic processing. Note that the program may be pre-installed in the ROM or another storage medium, may be provided in the form of being stored in the computer-readable storage medium, or may be distributed via a wired or wireless communication method, or the like. Examples of the computer-readable storage medium include a magnetic disk, a magneto-optical disk, a CD-ROM, a DVD-ROM, a semiconductor memory, and the like.

Description of Operation of Sheet Stacking Device

FIG. 6 to FIG. 10 are schematic diagrams illustrating an operation of the sheet stacking device.

Figure 6:
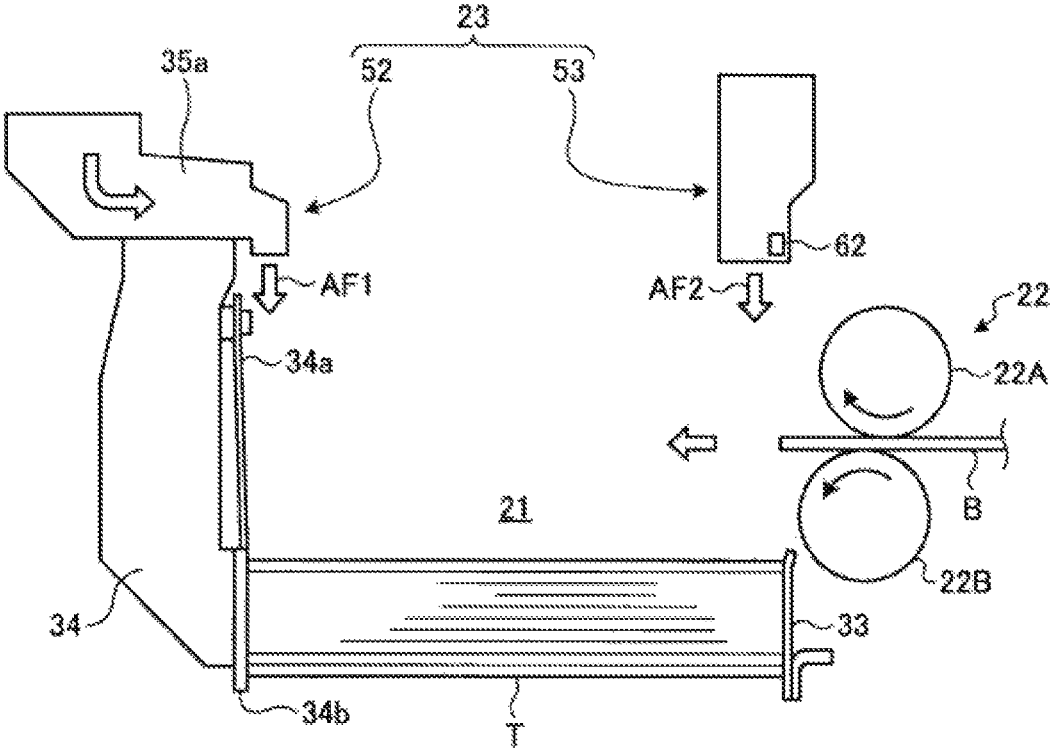
FIG. 6 is a schematic diagram illustrating an operation of the sheet stacking device.

As illustrated in FIG. 6, the corrugated cardboard box B is transported to the hopper unit 21 by the feeding rolls 22, and is stacked inside the hopper unit 21. At this time, the air flows AF1 and AF2 jetted downward from the air blower device 24 (52, 53) are applied to the tip end portion and the rear end portion of the corrugated cardboard box B, and the fall of the corrugated cardboard box B is promoted.

In other words, the corrugated cardboard box B is fed out by the feeding rolls 22 to the space above the hopper unit 21 along the horizontal direction. When the tip end portion of the corrugated cardboard box B enters the space above the hopper unit 21, the second air blower device 53 jets the air flow AF2 toward the upper surface of the tip end portion of the corrugated cardboard box B. Then, the posture of the corrugated cardboard box B is stabilized, and the fall of the corrugated cardboard box B is urged. Note that when the tip end portion of the corrugated cardboard box B enters the space above the hopper unit 21, the second air blower device 53 may be in a stopped state.

Figure 7:
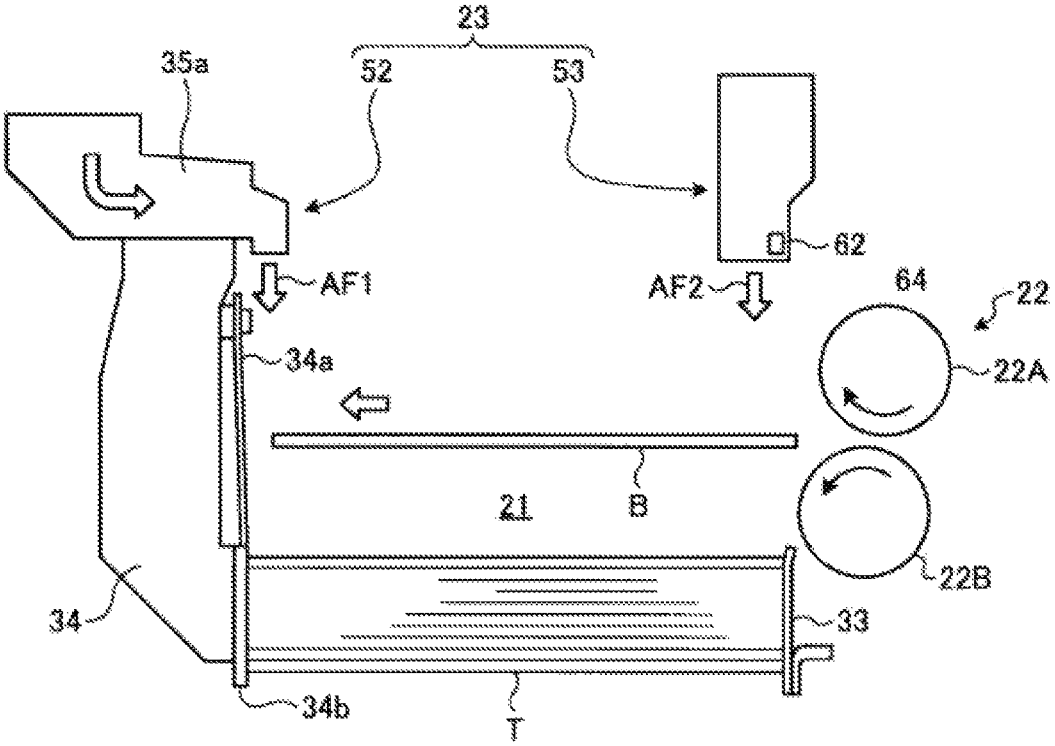
FIG. 7 is a schematic diagram illustrating the operation of the sheet stacking device.

As illustrated in FIG. 7, when the tip end portion of the corrugated cardboard box B approaches the flexible stop plate 34*a* of the front stop 34, the first air blower device 52 jets the air flow AF1 toward the upper surface of the tip end portion of the corrugated cardboard box B. Further, the second air blower device 53 jets the air flow AF2 toward the upper surface of the rear end portion of the corrugated cardboard box B. In this way, the corrugated cardboard box B is pressed downward.

Figure 8:
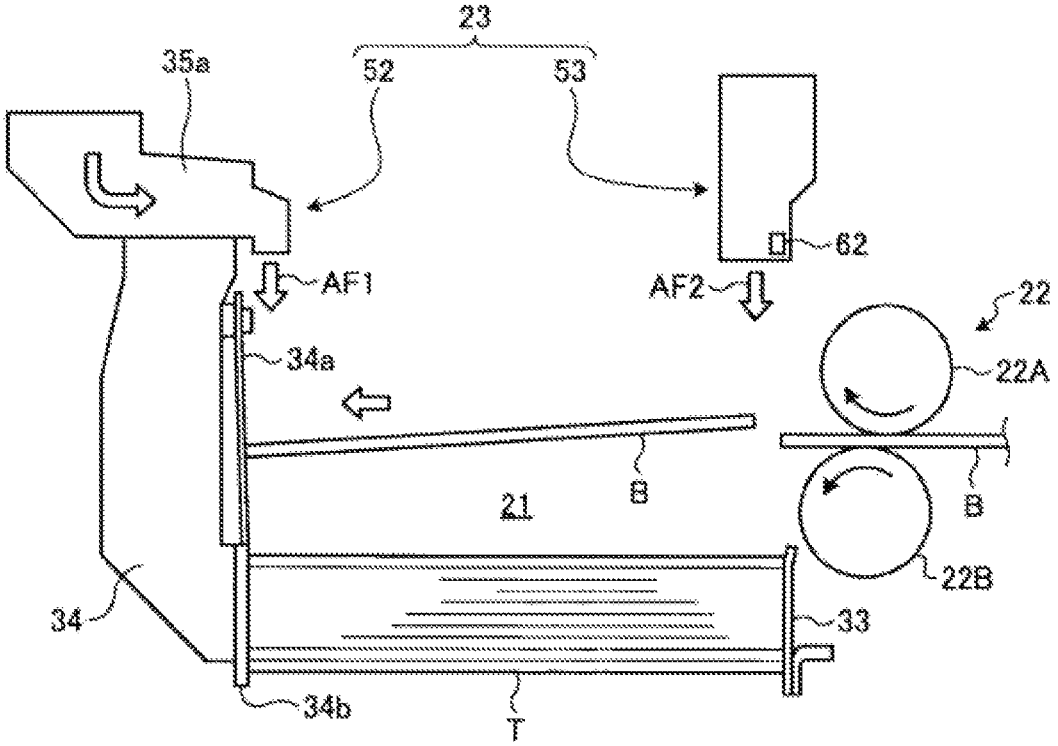
FIG. 8 is a schematic diagram illustrating the operation of the sheet stacking device.

As illustrated in FIG. 8, the corrugated cardboard box B that has been fed out to the space above the hopper unit 21 moves forward having a substantially horizontal posture, and the tip end portion thereof comes into contact with the flexible stop plate 34*a* of the front stop 34. When the tip end portion of the corrugated cardboard box B comes into contact with the flexible stop plate 34*a* of the front stop 34, the flexible stop plate 34*a* absorbs the kinetic energy of the corrugated cardboard box B while warping, and decelerates the movement of the corrugated cardboard box B.

Figure 9:
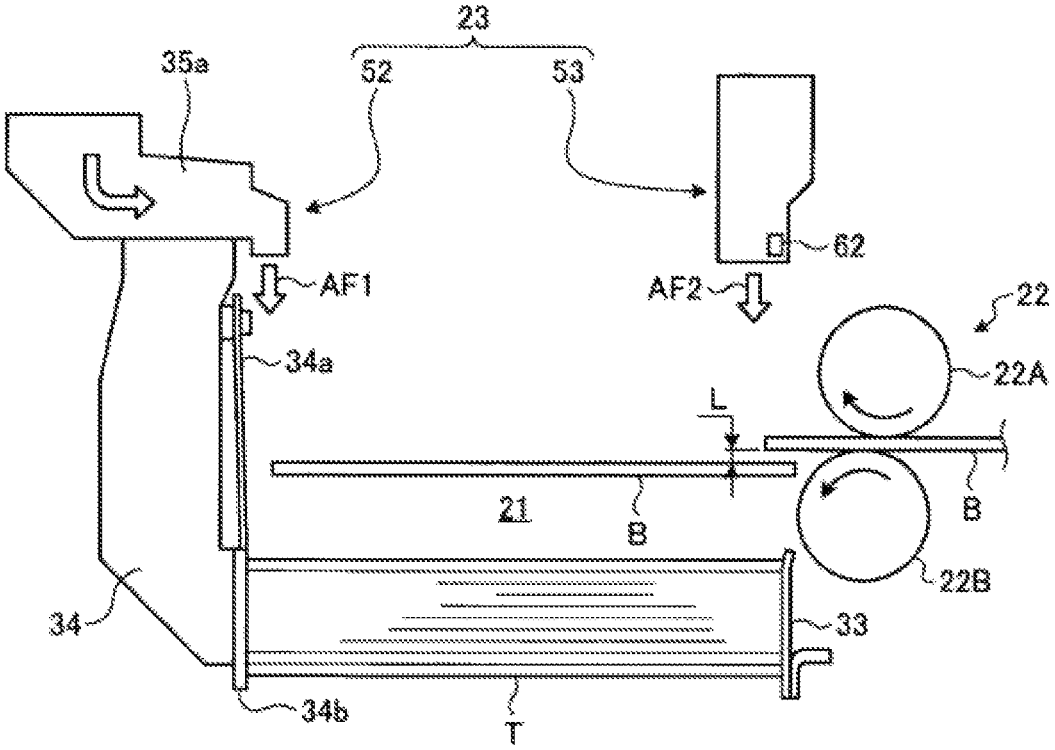
FIG. 9 is a schematic diagram illustrating the operation of the sheet stacking device.

As illustrated in FIG. 9, the corrugated cardboard box B, which has been decelerated by the tip end portion thereof coming into contact with the flexible stop plate 34*a*, falls due to its own weight and the air flows AF1 and AF2 from the air blower device 24 (52, 53). Then, with respect to the corrugated cardboard box B falling into the hopper unit 21, the next corrugated cardboard box B is fed out to the space above the hopper unit 21 by the feeding rolls 22. At this time, as illustrated in FIG. 3 and FIG. 9, the distance detection unit 71 calculates the inter-sheet distance L, in the vertical direction, between the rear end portion of the preceding corrugated cardboard box B and the tip end portion of the subsequent corrugated cardboard box B, based on the positions (heights) of the corrugated cardboard boxes B detected by the first height detection sensor 62. The determination unit 72 makes a determination by comparing the inter-sheet distance L calculated by the distance detection unit 71 with the inter-sheet distance control value Ls. The output unit 73 outputs the sheet feeding speed command value for the corrugated cardboard box B to the transport drive device 23, based on the determination result determined by the determination unit 72.

Here, when the inter-sheet distance L is greater than the inter-sheet distance control value Ls, that is, when the inter-sheet distance L, in the vertical direction, between the rear end portion of the preceding corrugated cardboard box B and the tip end portion of the subsequent corrugated cardboard box B is large, the sheet feeding speed command value is increased. In other words, since there is still a margin in the inter-sheet distance L, it is possible to further increase the transport speed in order to increase productivity. Thus, the transport speed of the corrugated cardboard box B is increased. On the other hand, when the inter-sheet distance L is smaller than the inter-sheet distance control valve Ls, that is, when the inter-sheet distance L, in the vertical direction, between the rear end portion of the preceding corrugated cardboard box B and the tip end portion of the subsequent corrugated cardboard box B is too small, the sheet feeding speed command value is decreased. In other words, since the inter-sheet distance L is too small, there is a risk that sheet jamming may occur from the rear end portion of the preceding corrugated cardboard box B and the tip end portion of the subsequent corrugated cardboard box B coming into contact with each other. Thus, the transport speed of the corrugated cardboard box B is decreased.

Note that, at this time, the control device 25 may not necessarily output the sheet feeding speed command value for the corrugated cardboard box B to the transport drive device 23 based on the inter-sheet distance L. and may cause the display device 64 to notify the operator that the transport drive device 23 needs to be adjusted. For example, when the inter-sheet distance L is large, the display device 64 is caused to display information indicating that the sheet feeding speed command value can be increased. Further, when the inter-sheet distance L is too small, it is assumed that the sheet jamming is likely to occur, and the display device 64 is caused to display information indicating that the sheet feeding speed command value should be decreased.

Figure 10:
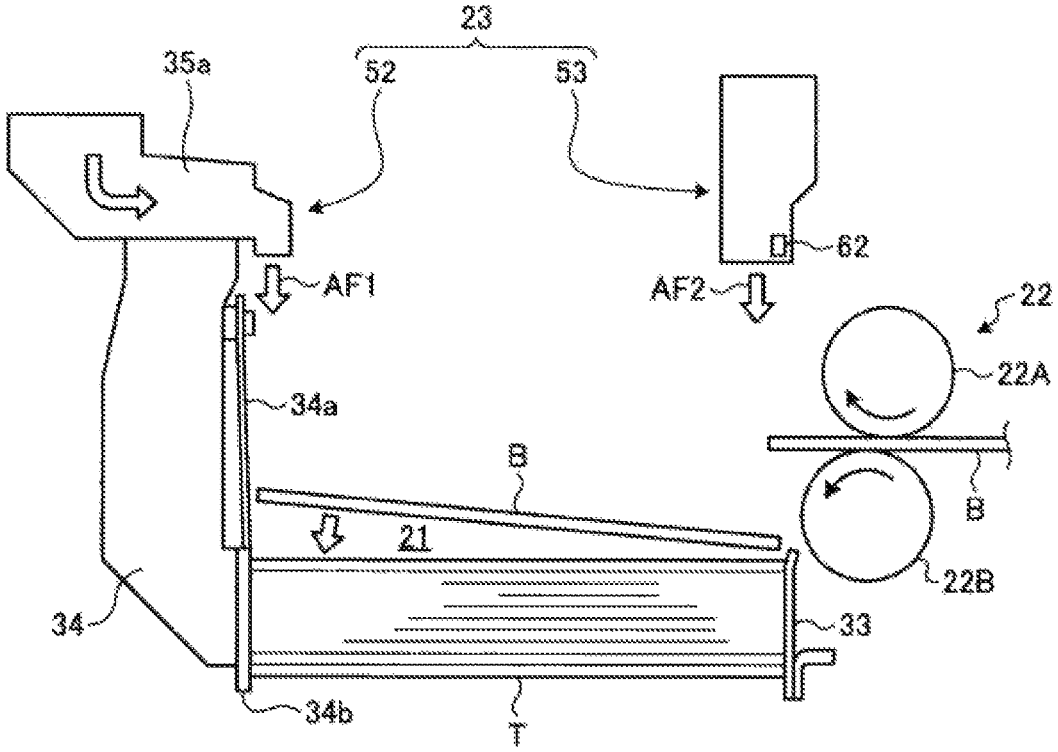
FIG. 10 is a schematic diagram illustrating the operation of the sheet stacking device.

When the contact between the rear end portion of the preceding corrugated cardboard box B and the tip end portion of the subsequent corrugated cardboard box B is avoided, the tip end portion of the preceding corrugated cardboard box B is pressed downward by the air flow AF1 from the first air blower device 52, and the rear end portion of the preceding corrugated cardboard box B is pressed downward by the air flow AF2 from the second air blower device 53, as illustrated in FIG. 10. Thus, the corrugated cardboard box B obtains a stable posture and falls into the hopper unit 21. Then, while the rear end portion of the corrugated cardboard box B comes into contact with the spanker 33 and is positioned, the corrugated cardboard box B maintains a substantially horizontal posture and is stacked in an appropriate manner. After the predetermined number of the appropriate stack T are stacked to form a batch, then the corrugated cardboard boxes B are ejected.

Second Embodiment

Figure 11:
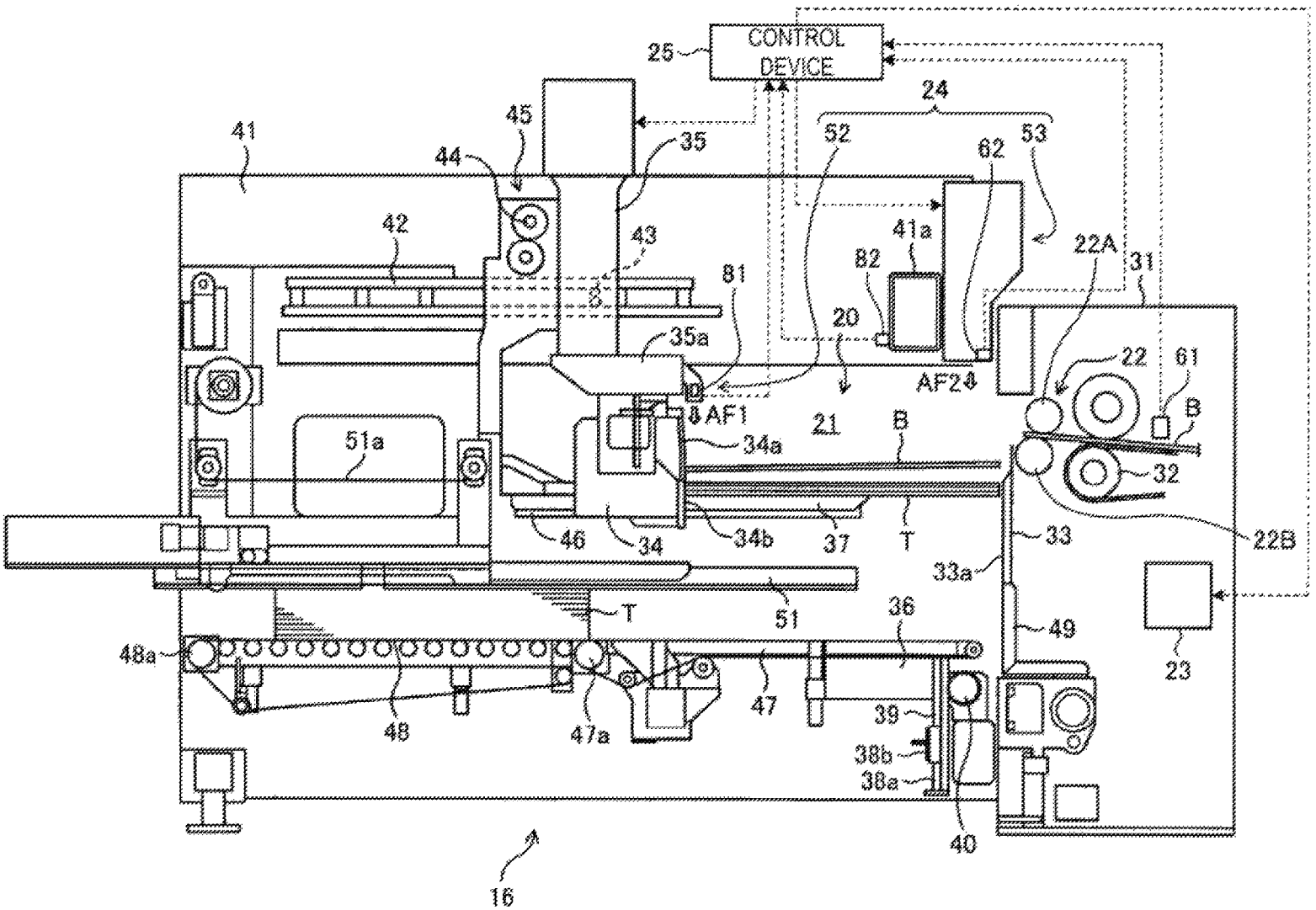
FIG. 11 is a schematic configuration diagram illustrating the counter ejector provided with the sheet stacking device according to a second embodiment.
Figure 12:
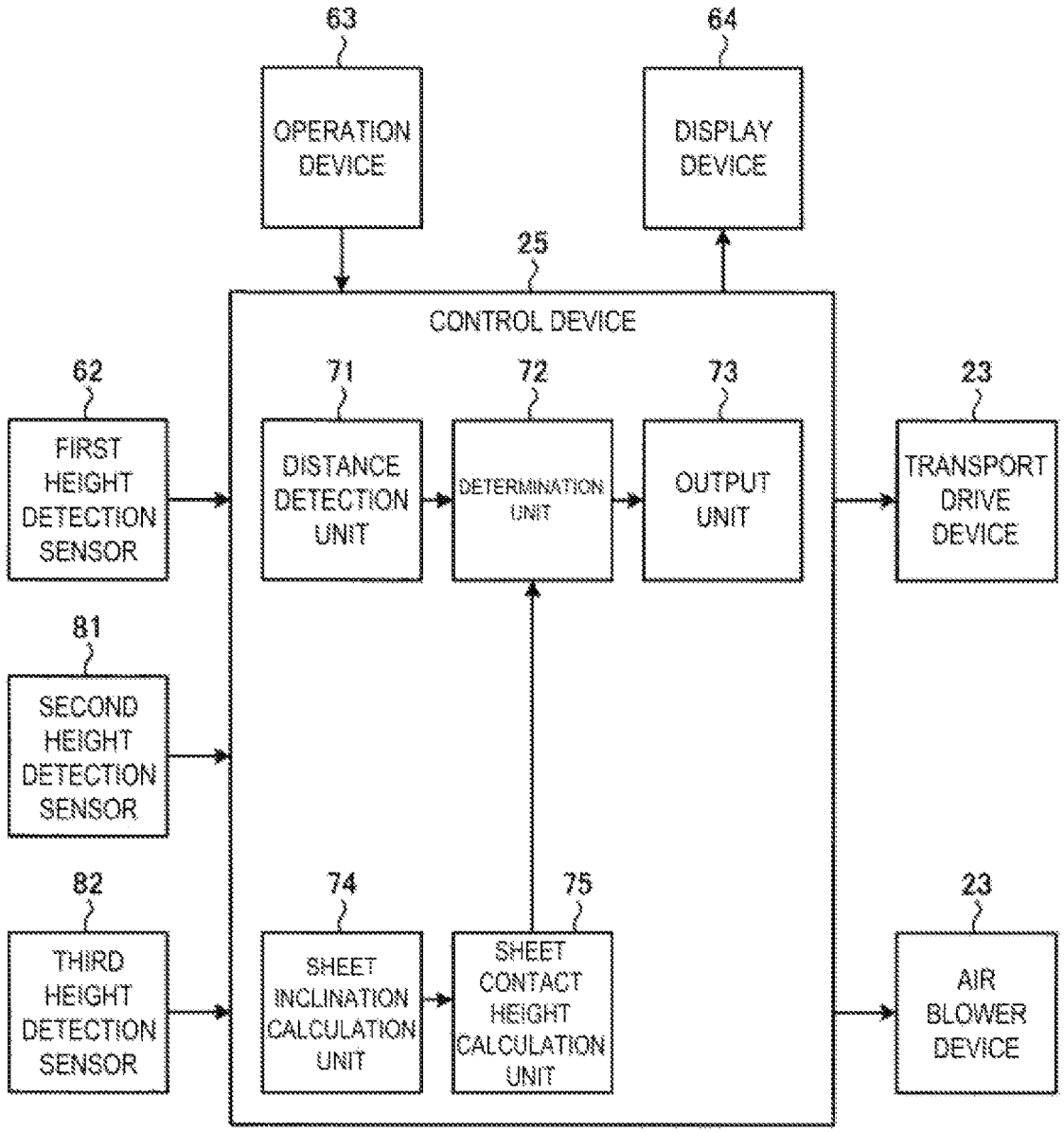
FIG. 12 is a block diagram illustrating a control system of the sheet stacking device according to the second embodiment.
Figure 13:
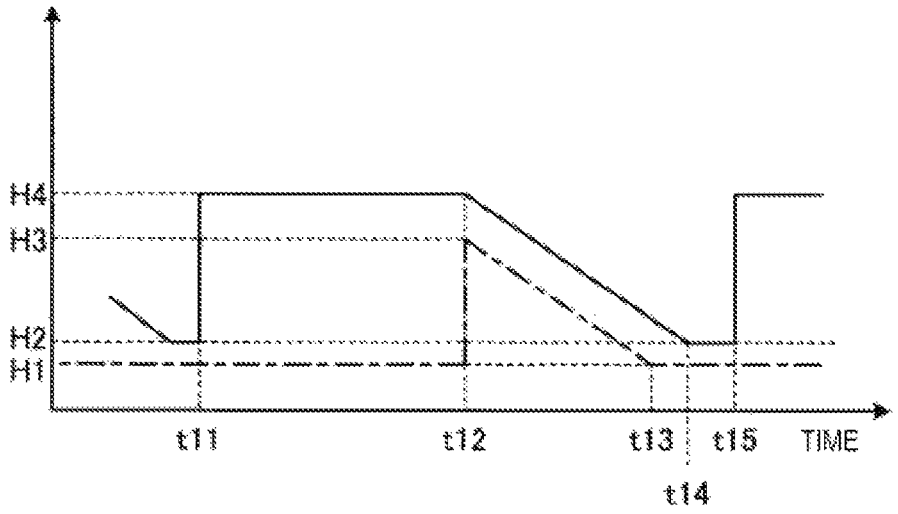
FIG. 13 is a graph showing changes in the distance detection value of the sheet.

FIG. 11 is a schematic configuration diagram illustrating the counter ejector provided with the sheet stacking device according to a second embodiment, FIG. 12 is a block diagram illustrating a control system of the sheet stacking device according to the second embodiment, and FIG. 13 is a graph showing changes in the distance detection value of the sheet.

In the second embodiment, as illustrated in FIG. 11 and FIG. 12, in addition to the first height detection sensor 62, a second height detection sensor 81 and a third height detection sensor 82 are provided. The first height detection sensor 62 is disposed on the upstream side of the hopper unit 21 in the transport direction of the corrugated cardboard box B. The second height detection sensor 81 is disposed on the downstream side of the hopper unit 21 in the transport direction of the corrugated cardboard box B. The third height detection sensor 82 is disposed between the first height detection sensor 62 and the second height detection sensor 81 at an intermediate position, in the hopper unit 21, in the transport direction of the corrugated cardboard box B. The second height detection sensor 81 and the third height detection sensor 82 are, for example, non-contact laser distance sensors that detect the position of the corrugated cardboard box B in the vertical direction, that is, the height of the corrugated cardboard box B.

In addition to the distance detection unit 71, the determination unit 72, and the output unit 73, the control device 25 includes a sheet inclination calculation unit 74 and a sheet contact height calculation unit 75.

The sheet inclination calculation unit 74 calculates an inclination, that is, an inclination angle with respect to the horizontal direction, of the corrugated cardboard box B, which is transported in the space above the hopper unit 21, based on the positions (heights) of the corrugated cardboard box B detected by the second height detection sensor 81 and the third height detection sensor 82. The sheet contact height calculation unit 75 calculates a sheet contact height H at which the tip end portion of the corrugated cardboard box B comes into contact with the front stop 34 (the flexible stop plate 34*a*), based on the positions (heights) of the corrugated cardboard box B detected by the second height detection sensor 81 and the third height detection sensor 82, and the inclination of the corrugated cardboard box B calculated by the sheet inclination calculation unit 74. The determination unit 72 makes a determination by comparing the sheet contact height H calculated by the sheet contact height calculation unit 75 with a preset sheet contact height control value Hs.

The output unit 73 outputs a behavior stabilization command for the corrugated cardboard box B based on a determination result determined by the determination unit 72. In the second embodiment, the behavior stabilization command is an air supply amount from the air blower device 24, or the sheet feeding speed command value for the corrugated cardboard box B. In other words, based on the sheet contact height H, the control device 25 outputs the air supply amount to the air blower device 24, and the sheet feeding speed command value for the corrugated cardboard box B to the transport drive device 23.

The corrugated cardboard box B is fed out to the space above the hopper unit 21 by the feeding rolls 22, and the tip end portion thereof comes into contact with the front stop 34, then the corrugated cardboard box B falls. At this time, the corrugated cardboard box B moves forward having a substantially horizontal posture, and the tip end portion thereof coming into contact with the flexible stop plate 34*a* of the front stop 34. The flexible stop plate 34*a* absorbs the kinetic energy of the corrugated cardboard box B while warping, and the corrugated cardboard box B decelerates. Therefore, if the tip end portion of the corrugated cardboard box B does not come into contact with a predetermined position (height) of the flexible stop plate 34*a*, the kinetic energy is not appropriately absorbed and the corrugated cardboard box B bounces back, and thus a stable fall cannot be ensured. Thus, by bringing the tip end portion of the corrugated cardboard box B coming into contact with an appropriate position of the flexible stop plate 34*a*, the stable fall of the corrugated cardboard box B is ensured.

As illustrated in FIG. 1I and FIG. 13, the third height detection sensor 82 is disposed above an intermediate portion of the hopper unit 21 in the transport direction of the corrugated cardboard box B. and detects the corrugated cardboard box B fed out to the hopper unit 21. The third height detection sensor 82 detects a height H2, in the vertical direction, of the preceding corrugated cardboard box B, and detects a height H4, in the vertical direction, of the subsequent corrugated cardboard box B at a time point t11. Since the subsequent corrugated cardboard box B falls after coming into contact with the front stop 34, the height H4 is reduced and becomes the height H2 at a time point t14, and again, at a time point t15, comes to the height H4 when the next subsequent corrugated cardboard box B is detected. Meanwhile, the second height detection sensor 81 is disposed above an end portion of the hopper unit 21 on the downstream side in the transport direction of the corrugated cardboard box B, and detects the corrugated cardboard box B fed out to the hopper unit 21. The second height detection sensor 81 detects a height H1, in the vertical direction, of the preceding corrugated cardboard box B, and detects a height H3 in the vertical direction, of the subsequent corrugated cardboard box B at a time point t12. Since the subsequent corrugated cardboard box B falls after coming into contact with the front stop 34, the height H3 is reduced and becomes the height H1 at a time point t13.

The sheet inclination calculation unit 74 calculates the inclination of the corrugated cardboard box B based on the height H of the corrugated cardboard box B detected by the second height detection sensor 81 and the height H of the corrugated cardboard box B detected by the third height detection sensor 82 between the time point t12 and the time point t13, for example. The sheet contact height calculation unit 75 calculates the sheet contact height H of the corrugated cardboard box B, based on the height H of the corrugated cardboard box B detected by the second height detection sensor 81, the height H of the corrugated cardboard box B detected by the third height detection sensor 82, and the inclination of the corrugated cardboard box B calculated by the sheet inclination calculation unit 74.

Note that in the description above, the sheet inclination calculation unit 74 calculates the inclination of the corrugated cardboard box B based on the height H of the corrugated cardboard box B detected by the second height detection sensor 81 and the height H of the corrugated cardboard box B detected by the third height detection sensor 82, but the method is not limited thereto. For example, the sheet inclination calculation unit 74 may calculate the inclination of the corrugated cardboard box B based on the height H of the corrugated cardboard box B detected by the second height detection sensor 81 and the height H of the corrugated cardboard box B detected by the first height detection sensor 62. Further, the sheet inclination calculation unit 74 may calculate the inclination of the corrugated cardboard box B based on the height H of the corrugated cardboard box B detected by the first height detection sensor 62 and the height H of the corrugated cardboard box B detected by the third height detection sensor 82. And in the description above, the sheet contact height calculation unit 75 calculates the sheet contact height H of the corrugated cardboard box B based on the inclination of the corrugated cardboard box B calculated by the sheet inclination calculation unit 74, but the method is not limited thereto. For example, the height H of the corrugated cardboard box B detected by the second height detection sensor 81, or a height obtained by correcting this height H may be used as the sheet contact height H of the corrugated cardboard box B.

As illustrated in FIG. 12, the determination unit 72 makes the determination by comparing the sheet contact height H calculated by the sheet contact height calculation unit 75 with the preset sheet contact height control value Hs. The sheet contact height control value Hs is the height of a center position of the flexible stop plate 34*a* in the front stop 34, but is preferably set to be a height range (100 mm, for example) obtained by taking into account a predetermined degree of margin. However, it is sufficient that the sheet contact height control value Hs is appropriately set in accordance with the size and thickness of the corrugated cardboard box B. The output unit 73 outputs the sheet feeding speed command value for the corrugated cardboard box B to the transport drive device 23 based on the determination result of the determination unit 72. Here, in order to increase the air supply amount and prevent the corrugated cardboard box B from bouncing back from the stop plate 34*a*, when it is determined that the sheet contact height H is higher than the sheet contact height control value Hs, the output unit 73 decreases the sheet feeding speed command value. On the other hand, when it is determined that the sheet contact height H is lower than the sheet contact height control value Hs, the air supply amount is reduced, and the sheet feeding speed command value is also decreased to prevent the bounce back of the corrugated cardboard box B from the stop plate 34*a*.

Note that, similarly to the first embodiment, the control device 25 need not necessarily output the sheet feeding speed command value for the corrugated cardboard box B to the transport drive device 23 based on the sheet contact height H, and may cause the display device 64 to notify the operator that the transport drive device 23 needs to be adjusted. For example, when the sheet contact height H is higher than the sheet contact height control value Hs, the control device 25 causes the display device 64 to display information indicating that the air supply amount should be increased, and the sheet feeding speed command value should be decreased. Further, when the sheet contact height H is lower than the sheet contact height control value Hs, the control device 25 causes the display device 64 to display information indicating that the air supply amount should be reduced, and the sheet feeding speed command value should be decreased.

Actions and Effects of Present Embodiment

A sheet stacking device according to a first aspect includes a hopper unit 21 configured to stack a corrugated cardboard box B, feeding rolls (a feeding unit) 22 configured to feed out the corrugated cardboard box B to the hopper unit 21, a distance detection unit 71 configured to detect an inter-sheet distance L, in a vertical direction, between a rear end portion of the corrugated cardboard box B that is preceding and a tip end portion of the corrugated cardboard box B that is subsequent, and an output unit 73 configured to output, based on the inter-sheet distance L, a behavior stabilization command for the corrugated cardboard box B.

The sheet stacking device according to the first aspect outputs the behavior stabilization command for the corrugated cardboard box B based on the inter-sheet distance L, in the vertical direction, between the rear end portion of the corrugated cardboard box B that is preceding and the tip end portion of the corrugated cardboard box B that is subsequent. Thus, by outputting the behavior stabilization command for the corrugated cardboard box B based on the inter-sheet distance L, the sheet stacking device can execute processing for appropriately stacking the corrugated cardboard boxes B in the hopper unit 21 based on the behavior stabilization command. As a result, an occurrence of a production loss due to sheet jamming caused by the corrugated cardboard boxes B coming into contact with each other can be suppressed, and at the same time, workability of a stacking operation of the corrugated cardboard boxes B can be improved. Further, by increasing the transport speed of the corrugated cardboard boxes B, productivity can be improved.

The sheet stacking device according to a second aspect includes the feeding rolls 22 and a transport drive device 23 that drives the feeding rolls 22, and based on the inter-sheet distance L, the output unit 23 outputs a sheet feeding speed command value as the behavior stabilization command to the transport drive device 23. In this way, the rotational speed of the feeding rolls 22 by the transport drive device 23 is adjusted in accordance with the inter-sheet distance L. and this makes it possible to suppress the contact between the corrugated cardboard boxes B, and to efficiently transport the corrugated cardboard boxes B by the feeding rolls 22.

The sheet stacking device according to a third aspect includes a determination unit 72 configured to make a determination by comparing the inter-sheet distance L with an inter-sheet distance control value Ls that is preset. When the determination unit 72 determines that the inter-sheet distance L is greater than the inter-sheet distance control value Ls, the output unit 73 increases the sheet feeding speed command value. In this way, by increasing the transport speed of the corrugated cardboard boxes B by the feeding rolls 22, the productivity can be improved.

In the sheet stacking device according to a fourth aspect, when the determination unit 72 determines that the inter-sheet distance L is smaller than the inter-sheet distance control value Ls, the output unit 73 decreases the sheet feeding speed command value. In this way, by increasing the transport speed of the corrugated cardboard boxes B by the feeding rolls 22, the productivity can be improved, and at the same time, the contact between the corrugated cardboard boxes B can be suppressed.

The sheet stacking device according to a fifth aspect includes a display device 64 as an alarm device. Based on the inter-sheet distance L, the output unit 73 outputs an alarm command value as the behavior stabilization command to the display device 64. In this way, by displaying the behavior stabilization command for the corrugated cardboard box B based on the inter-sheet distance L, the sheet stacking device can prompt an operator to perform the processing for appropriately stacking the corrugated cardboard boxes B in the hopper unit 21 based on the behavior stabilization command.

The sheet stacking device according to a sixth aspect includes a determination unit 72 configured to make a determination by comparing the inter-sheet distance L with an inter-sheet distance control value Ls that is preset. The output unit 73 outputs the alarm command value to the display device 64 based on a determination result of the determination unit 72. In this way, the sheet stacking device can make the operator to execute the processing for appropriately stacking the corrugated cardboard boxes B in the hopper unit 21.

The sheet stacking device according to a seventh aspect includes an air blower device 24 configured to blow air, from above, toward the corrugated cardboard box B fed out by the feeding rolls 22 to a space above the hopper unit 21, and a determination unit 72 configured to make a determination by comparing the inter-sheet distance L with an inter-sheet distance control value Ls that is preset. Based on a determination result of the determination unit 72, the output unit 73 outputs an air flow rate command value to the air blower device 24 as the behavior stabilization command. In this way, a pressing force acting on the corrugated cardboard box B by the air blower device 24 is adjusted in accordance with the inter-sheet distance L, and this makes it possible to suppress the contact between the corrugated cardboard boxes B, and to efficiently stack the corrugated cardboard boxes B in the hopper unit 21.

The sheet stacking device according to an eighth aspect includes a first height detection sensor 62 configured to detect a height, in the vertical direction, of the corrugated cardboard box B fed out by the feeding rolls 22 to the space above the hopper unit 21. The first height detection sensor 62 is disposed in a range shifted from an end of the hopper unit 21 on an upstream side in a transport direction of the corrugated cardboard box B, toward a downstream side by a preset predetermined distance. In this way, the inter-sheet distance L, in the vertical direction, between the rear end portion of the corrugated cardboard box B that is preceding and the tip end portion of the corrugated cardboard box B that is subsequent can be detected in a highly accurate manner.

The sheet stacking device according to a ninth aspect includes a sheet contact height calculation unit 75 configured to detect a sheet contact height H at which a tip end portion of the corrugated cardboard box B fed out by the feeding rolls 22 to the space above the hopper unit 21 comes into contact with a front stop (a stopper) 34 disposed on the downstream side of the hopper unit 21 in the transport direction of the corrugated cardboard box B. The output unit 73 outputs the behavior stabilization command for the corrugated cardboard box B based on the sheet contact height H. In this way, by outputting the behavior stabilization command for the corrugated cardboard box B based on the sheet contact height H, the sheet stacking device can execute the processing for appropriately stacking the corrugated cardboard boxes B in the hopper unit 21 based on the behavior stabilization command.

The sheet stacking device according to a tenth aspect includes a second height detection sensor 81 and a third height detection sensor 82 disposed at positions separated from each other in the transport direction of the corrugated cardboard box B, and a sheet inclination calculation unit 74 configured to calculate an inclination of the corrugated cardboard box B based on detection results of the second height detection sensor 81 and the third height detection sensor 82. The sheet contact height calculation unit 75 estimates the sheet contact height H based on the inclination of the corrugated cardboard box B. In this way, the sheet contact height H can be calculated in a highly accurate manner.

The sheet stacking device according to an eleventh aspect includes a determination unit 72 configured to make a determination by comparing the sheet contact height H and a sheet contact height control value Hs that is preset. Based on a determination result of the determination unit 72, the output unit 73 outputs at least one of an air supply amount command value to an air blower device 24, and a sheet feeding speed command value to the transport drive device 23 as the behavior stabilization command. In this way, a supply amount and a supply direction of the air from the air blower device 24 and the rotational speed of the feeding rolls 22 by the transport drive device 23 are adjusted in accordance with the sheet contact height H. Thus, the tip end portion of the corrugated cardboard box B can be brought into contact with an appropriate position of the front stop 34 in a highly accurate manner, and the corrugated cardboard boxes B can be efficiently stacked in the hopper unit 21.

The sheet stacking device according to a twelfth includes a display device 64 as an alarm device, and a determination unit 72 configured to make a determination by comparing the sheet contact height H with a sheet contact height control value Hs that is preset. Based on a determination result of the determination unit 72, the output unit 73 outputs an alarm command value to the display device 64. In this way, by displaying the behavior stabilization command for the corrugated cardboard box B based on the sheet contact height H, the sheet stacking device can prompt the operator to perform the processing for appropriately stacking the corrugated cardboard boxes B in the hopper unit 21 based on the behavior stabilization command.

A sheet stacking method according to a thirteenth aspect includes feeding out a corrugated cardboard box B to a hopper unit 21, detecting a distance, in a vertical direction, between a rear end portion of the corrugated cardboard box B and a tip end portion of the corrugated cardboard box B that is subsequent, and outputting a behavior stabilization command for the corrugated cardboard box B based on the distance in the vertical direction. In this way, the processing for appropriately stacking the corrugated cardboard boxes B in the hopper unit 21 based on the behavior stabilization command can be executed. As a result, the contact between the corrugated cardboard boxes B can be suppressed, and the workability of the stacking operation of the corrugated cardboard boxes B can be improved.

A sheet stacking program according to a fourteenth aspect causes a computer to execute processing for feeding out a corrugated cardboard box B to a hopper unit 21, processing for detecting a distance, in a vertical direction, between a rear end portion of the corrugated cardboard box B and a tip end portion of the corrugated cardboard box B that is subsequent, and processing for outputting a behavior stabilization command for the corrugated cardboard box B based on the distance in the vertical direction. In this way, the processing for appropriately stacking the corrugated cardboard boxes B in the hopper unit 21 based on the behavior stabilization command can be executed. As a result, an occurrence of a production loss due to sheet jamming caused by the corrugated cardboard boxes B coming into contact with each other can be suppressed, and at the same time, workability of a stacking operation of the corrugated cardboard boxes B can be improved.

A counter ejector according to a fifteenth aspect includes the sheet stacking device 20. The counter ejector is configured to group the corrugated cardboard boxes B into batches of a predetermined number after stacking the corrugated cardboard boxes B while counting the corrugated cardboard boxes B, and eject the corrugated cardboard boxes B. In this way, the processing for appropriately stacking the corrugated cardboard boxes B in the hopper unit 21 based on the behavior stabilization command can be executed. As a result, the contact between the corrugated cardboard boxes B can be suppressed, and the workability of the stacking operation of the corrugated cardboard boxes B can be improved.

A box making machine according to a sixteenth aspect includes a sheet feeding unit 11 configured to supply a corrugated cardboard sheet S, a printing unit 12 configured to perform printing on the corrugated cardboard sheet S, a sheet ejection unit 13 configured to perform ruled line processing and groove cutting processing on a surface of the corrugated cardboard sheet S, a folder gluer unit 15 configured to form a corrugated cardboard box B by folding the corrugated cardboard sheet S and joining end portions of the corrugated cardboard sheet S, and a counter ejector unit 16 configured to stack the corrugated cardboard boxes B while counting the corrugated cardboard boxes B, and eject the corrugated cardboard boxes B in batches of a predetermined number. In this way, using the counter ejector 16, the processing for appropriately stacking the corrugated cardboard boxes B in the hopper unit 21 based on the behavior stabilization command can be executed. As a result, the occurrence of the production loss due to the sheet jamming caused by the corrugated cardboard boxes B coming into contact with each other can be suppressed, and at the same time, the workability of the stacking operation of the corrugated cardboard boxes B and productivity of the box making machine 10 can be improved.

Note that in the embodiments described above, the feeding unit according to the present disclosure is configured by the feeding rolls 22 (the upper feeding roll 22A and the lower feeding roll 22B), but the configuration is not limited thereto. For example, the feeding unit may be a transport conveyor or any other feeding device.

Further, in the embodiments described above, the box making machine 10 is configured by the sheet feeding unit 11, the printing unit 12, the sheet ejection unit 13, the die cutting unit 14, the folder gluer unit 15, and the counter ejector unit 16, but when the hand hole is not required in the corrugated cardboard sheet S, the box making machine 10 may be configured without the die cutting unit 14.

Further, in the embodiments described above, the sheet is described as the corrugated cardboard box B, but the sheet may be the corrugated cardboard sheet S, or may be any other sheet such a piece of paper, for example.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A sheet stacking device comprising:

a hopper unit configured to stack a sheet;

a feeding unit configured to feed out the sheet to the hopper unit;

a distance detection unit configured to detect an inter-sheet distance, in a vertical direction, between a rear end portion of a preceding sheet that is fed out by the feeding unit, and a tip end portion of the sheet as the sheet is subsequently fed out by the feeding unit after the preceding sheet; and an output unit that controls a sheet feeding speed by outputting, based on the inter-sheet distance, a first behavior stabilization command for the sheet.

2. The sheet stacking device according to claim 1, wherein the feeding unit includes a pair of upper and lower feeding rolls, and a transport drive device configured to drive the feeding rolls, and the output unit outputs, based on the inter-sheet distance, a sheet feeding speed command value as the first behavior stabilization command to the transport drive device to control the sheet feeding speed.

3. The sheet stacking device according to claim 2, further comprising:

a determination unit configured to make a determination by comparing the inter-sheet distance with an inter-sheet distance control value that is preset, wherein when the determination unit determines that the inter-sheet distance is greater than the inter-sheet distance control value, the output unit increases the sheet feeding speed command value.

4. The sheet stacking device according to claim 3, wherein when the determination unit determines that the inter-sheet distance is smaller than the inter-sheet distance control value, the output unit decreases the sheet feeding speed command value.

5. The sheet stacking device according to claim 1, further comprising:

an alarm device, wherein the output unit outputs, based on the inter-sheet distance, an alarm command value to the alarm device as a second behavior stabilization command.

6. The sheet stacking device according to claim 5, further comprising:

a determination unit configured to make a determination by comparing the inter-sheet distance with an inter-sheet distance control value that is preset, wherein the output unit outputs the alarm command value to the alarm device, based on a determination result of the determination unit.

7. The sheet stacking device according to claim 1, further comprising:

an air blower device configured to blow air, from above, toward the sheet fed out by the feeding unit to a space above the hopper unit; and a determination unit configured to make a determination by comparing the inter-sheet distance with an inter-sheet distance control value that is preset, wherein the output unit outputs, based on a determination result of the determination unit, an air flow rate command value as a second behavior stabilization command to the air blower device.

8. The sheet stacking device according to claim 1, further comprising:

a first height detection sensor which detects a height, in the vertical direction, of the sheet fed out by the feeding unit to a space above the hopper unit, wherein the first height detection sensor is disposed in a range shifted from an end of the hopper unit on an upstream side in a transport direction of the sheet, toward a downstream side by a preset predetermined distance.

9. The sheet stacking device according to claim 1, further comprising:

a sheet contact height detection unit configured to detect a sheet contact height at which a tip end portion of the sheet fed out by the feeding unit to a space above the hopper unit comes into contact with a stopper disposed on a downstream side of the hopper unit in a transport direction of the sheet, wherein the output unit outputs a second behavior stabilization command for the sheet based on the sheet contact height.

10. The sheet stacking device according to claim 9, further comprising:

a second height detection sensor and a third height detection sensor disposed at positions separated from each other in the transport direction of the sheet; and a sheet inclination calculation unit configured to calculate an inclination of the sheet based on detection results of the second height detection sensor and the third height detection sensor, wherein the sheet contact height detection unit estimates the sheet contact height based on the inclination of the sheet.

11. The sheet stacking device according to claim 9, wherein the feeding unit includes a pair of upper and lower feeding rolls, a transport drive device configured to drive the feeding rolls, and a determination unit configured to make a determination by comparing the sheet contact height and a sheet contact height control value that is preset, and the output unit outputs, based on a determination result of the determination unit, at least one of an air supply amount command value to an air blower device, and a sheet feeding speed command value as the first behavior stabilization command to the transport drive device.

12. The sheet stacking device according to claim 9, further comprising:

an alarm device; and a determination unit configured to make a determination by comparing the sheet contact height with a sheet contact height control value that is preset, wherein the output unit outputs, based on a determination result of the determination unit, an alarm command value to the alarm device.

* * * * *